US008638956B2

(12) United States Patent
Deng

(10) Patent No.: US 8,638,956 B2
(45) Date of Patent: Jan. 28, 2014

(54) ACOUSTIC VELOCITY MICROPHONE USING A BUOYANT OBJECT

(76) Inventor: Ken K. Deng, North Potomac, MD (US)

( * ) Notice: Subject to any disclaimer, the term of this patent is extended or adjusted under 35 U.S.C. 154(b) by 530 days.

(21) Appl. No.: 12/845,794

(22) Filed: Jul. 29, 2010

(65) Prior Publication Data

US 2011/0033062 A1 Feb. 10, 2011

Related U.S. Application Data

(60) Provisional application No. 61/273,564, filed on Aug. 6, 2009.

(51) Int. Cl.
*H04R 25/00* (2006.01)

(52) U.S. Cl.
USPC ..... 381/162; 381/171; 381/174; 381/369; 367/178; 367/182

(58) Field of Classification Search
USPC ..... 381/162, 171, 174, 369; 367/178, 182
See application file for complete search history.

(56) References Cited

U.S. PATENT DOCUMENTS

| | | | | |
|---|---|---|---|---|
| 4,655,086 | A | 4/1987 | Mielnicka-Pate et al. | |
| 5,155,708 | A | 10/1992 | Bedi et al. | |
| 5,959,217 | A | 9/1999 | De Bree et al. | |
| 6,370,084 | B1 | 4/2002 | Cray | |
| 6,922,059 | B2 * | 7/2005 | Zank et al. | 324/457 |
| 6,963,653 | B1 | 11/2005 | Miles | |
| 7,224,465 | B2 | 5/2007 | Balachandran et al. | |
| 7,240,544 | B2 | 7/2007 | Mallebay-Vacqueur et al. | |
| 7,327,849 | B2 * | 2/2008 | Sommerfeldt et al. | 381/71.7 |
| 7,367,232 | B2 * | 5/2008 | Vaganov et al. | 73/514.33 |
| 7,505,367 | B2 * | 3/2009 | Abdi | 367/134 |
| 7,802,474 | B2 * | 9/2010 | Maguire et al. | 73/514.16 |
| 8,085,622 | B2 * | 12/2011 | Donskoy et al. | 367/178 |
| 2002/0043110 | A1 | 4/2002 | Orten | |
| 2005/0034519 | A1 * | 2/2005 | Deng | 73/514.34 |
| 2006/0236772 | A1 | 10/2006 | Naluai et al. | |
| 2010/0281979 | A1 * | 11/2010 | McConnell et al. | 73/514.28 |

* cited by examiner

*Primary Examiner* — Ramon Barrera
(74) *Attorney, Agent, or Firm* — J.A. McKinney & Assoc., LLC

(57) ABSTRACT

Embodiments of a directional acoustic sensor or acoustic velocity microphone are disclosed that include a sensor frame structure, a support means, and a buoyant object. The buoyant object is suspended in the sensor frame structure using the support means. The buoyant object has a feature size smaller than a wavelength of the highest frequency of an acoustic wave in air. The buoyant object receives three-dimensional movement of the air excited by the acoustic wave. The three-dimensional movement that the buoyant object receives is detected using a detection means. A particle velocity of the acoustic wave is derived from the three-dimensional movement of the buoyant object using the detection means. The detection means can be an optical detection means, an electromagnetic detection means, or an electrostatic detection means. An acoustic image of the acoustic wave can be determined by distributing two or more directional acoustic sensors a multi-dimensional array.

20 Claims, 15 Drawing Sheets

700

ACOUSTIC VELOCITY MICROPHONE USING A BUOYANT OBJECT

CROSS-REFERENCE TO RELATED APPLICATION

This application claims the benefit of U.S. Provisional Patent Application No. 61/273,564, filed Aug. 6, 2009 and is hereby incorporated by reference in its entirety.

INTRODUCTION

Most microphones, i.e., sensors, can only measure acoustic pressure and cannot distinguish the direction of an incident sound wave. In other words, these microphones are omnidirectional sensors. A directional microphone/sensor is sensitive to the acoustic wave incident from one direction and insensitive to the waves from other directions. In many applications, acoustic pressure sensing alone is not enough. Other parameters, such as pressure gradient and particle velocity, are needed to fully understand the sound behavior in these applications.

BRIEF DESCRIPTION OF THE DRAWINGS

FIG. 6 is a schematic of an embodiment of the acoustic velocity microphone that uses soft wedges to confine the buoyant object in a sensor frame structure, in accordance with various embodiments.

Figure 1:
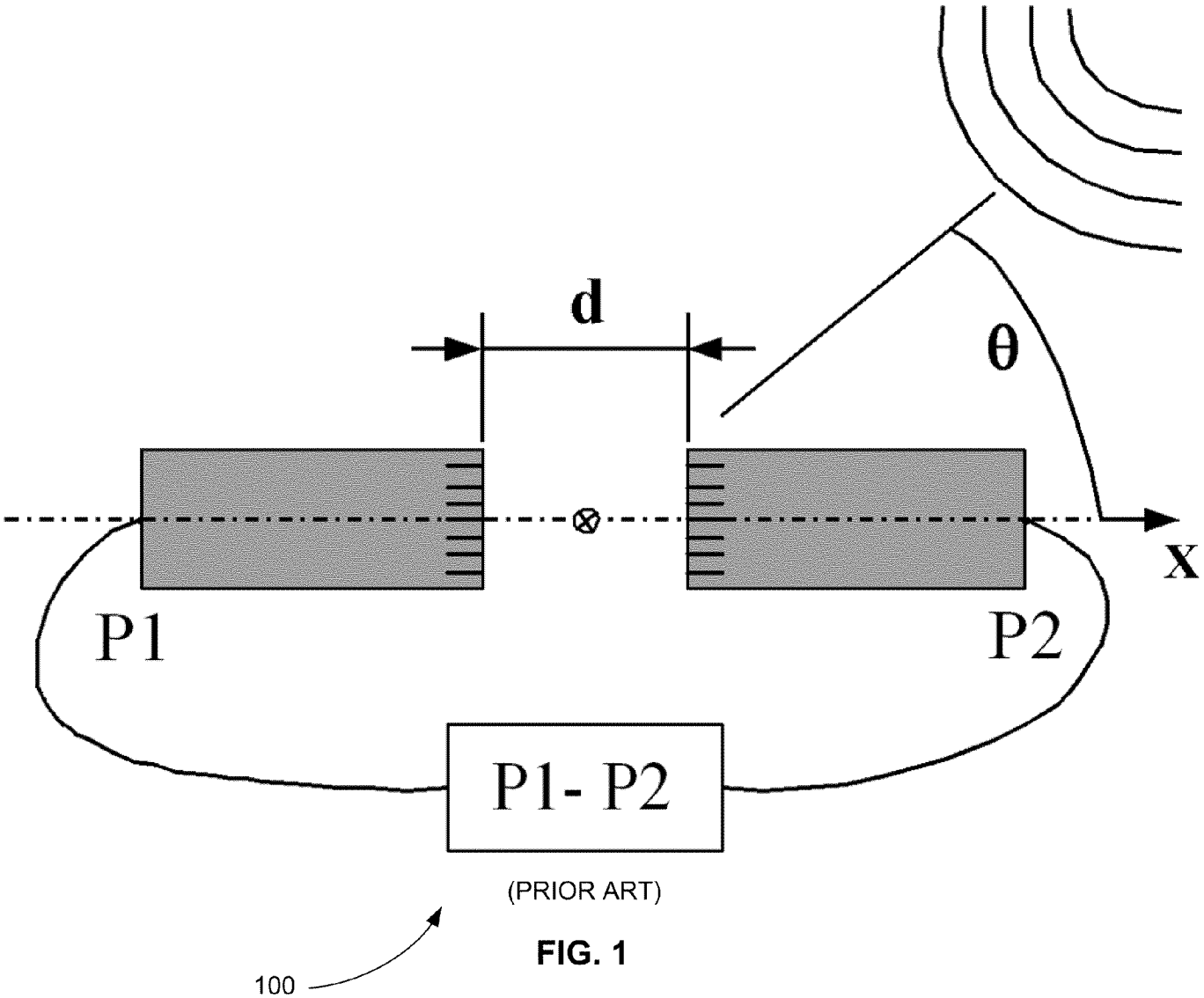
(PRIOR ART) FIG. 1
FIG. 1 is a schematic diagram of an exemplary prior art pressure gradient sensor using a finite difference method.

Before one or more embodiments of the invention are described in detail, one skilled in the art will appreciate that the invention is not limited in its application to the details of construction, the arrangements of components, and the arrangement of steps set forth in the following detailed description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION

There is a strong need for a vector type acoustic sensor such as an acoustic velocity microphone that is not a scalar pressure microphone. Currently two approaches exist for directional acoustic sensing. Fundamentally, both approaches rely on the acoustic pressure gradient to create the sensor's output.

FIG. 1 is a schematic diagram of an exemplary prior art pressure gradient sensor 100 using a finite difference method. Pressure gradient sensor 100 includes two matched omnidirectional microphones separated by a small distance d. A plane acoustic wave of amplitude P incident at an angle θ relative to the line along spacing d (designated as X axis in graph) can be expressed as, $$p(x,t)=P\cdot e^{j(\omega t-kx\cdot\cos\theta)} \tag{1}$$

where k is wave number (k=ω/c) and c is sound speed in air, ω is angular frequency.

The derivative of this pressure function with respect to distance x is the pressure gradient along X axis.

$$\frac{\partial p(x,t)}{\partial x}=j\frac{\omega}{c}\cdot P\cdot\cos\theta\cdot e^{j\omega t} \tag{2}$$

The output of the sensing system in FIG. 1 is the pressure difference between the two microphones divided by spacing d, and it is written as, $$\frac{p\left(+\frac{d}{2},t\right)-p\left(-\frac{d}{2},t\right)}{d}=\frac{P}{d}\cdot 2j\cdot e^{j\omega t}\cdot\sin\left(\frac{kd}{2}\cos\theta\right) \tag{3}$$

When the spacing d is small and frequency is not very high, i.e. kd<<1, the above finite difference becomes, $$\text{Output} = \frac{p\left(+\frac{d}{2}, t\right) - p\left(-\frac{d}{2}, t\right)}{d} = j\frac{\omega}{c} \cdot P \cdot \cos\theta \cdot e^{j\omega t} \tag{4}$$

which is the same as the theoretical pressure gradient given in equation (2). Thus, the output closely represents the pressure gradient at the center point between the two microphones. This approximation approach is referred to as a finite difference method.

The advantage of the finite difference scheme is that it can be easily realized and implemented by conventional pressure microphones. However, there are major drawbacks inherent with this approach. First, the paired microphones have to be precisely matched on their frequency responses (both in amplitude and phase). Any mismatch in the sensor's performance will yield large errors in final output. This tight performance matching requirement presents a challenge for mass producing this type of sensors. Second, as sound frequency goes lower, the acoustic wavelength becomes longer. Consequently, the difference between the two microphones diminishes, resulting in poor signal-to-noise ratio in low frequency range. Conversely, as the frequency gets high, the assumption $kd \ll 1$ will not hold true, which will introduce more errors deviating from the real pressure gradient given in equation (2). Third, the pressure gradient derived from the finite difference method is not constant in terms of the acoustic pressure or particle velocity in frequency domain.

Figure 2:
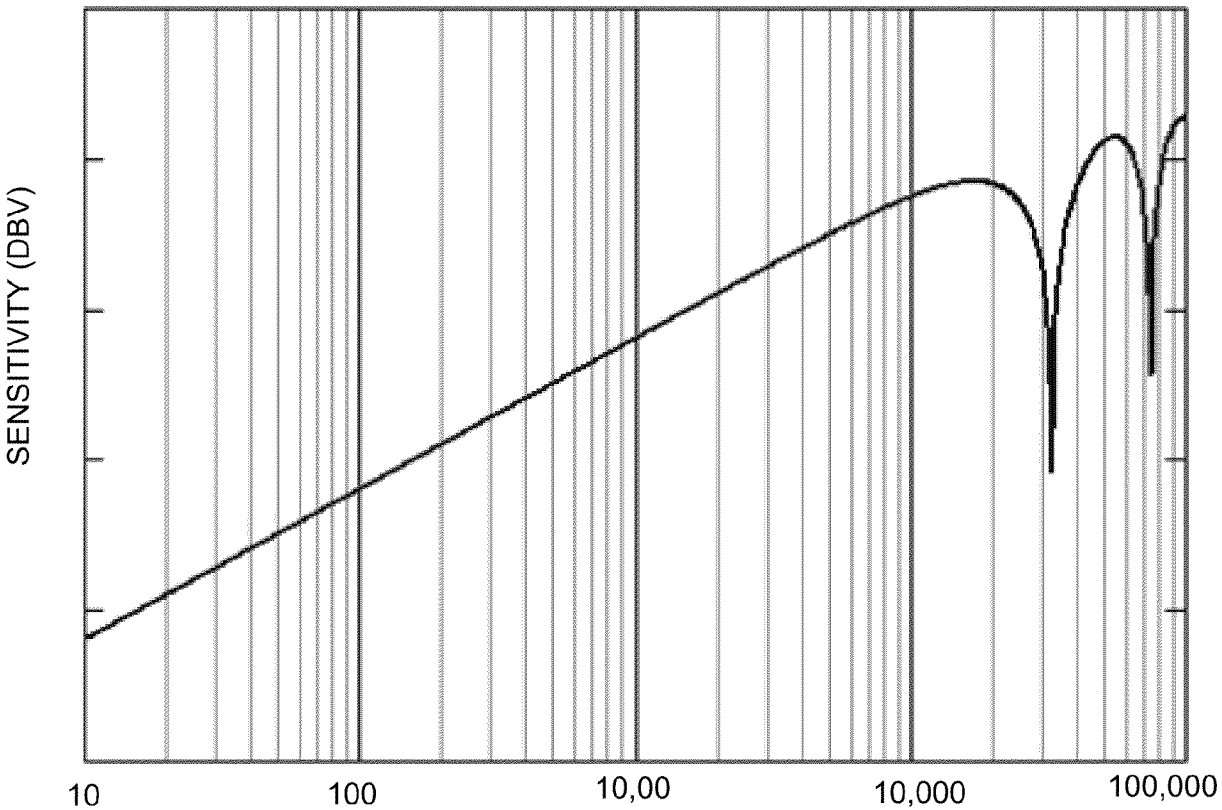
FIG. 2 is an exemplary plot 200 of the frequency response of the prior art pressure gradient sensor. The frequency response of plot 200 has a 20 dB/decade slope.

FIG. 2 is an exemplary plot 200 of the frequency response of the prior art pressure gradient sensor. The frequency response of plot 200 has a 20 dB/decade slope. This frequency response can be electronically compensated to achieve a flat sensitivity. But, the signal-to-noise (SNR) and measurement errors cannot be improved by any hardware and software compensation.

Another widely accepted approach is to employ a diaphragm on which the acoustic pressure gradient will exert a net force, and the dynamic response of the diaphragm is then detected as the output of pressure gradient. The majority of the directional microphones on market today are this type of sensor.

The diaphragm sensors directly measure a sound pressure gradient in a small area (defined by the size of the diaphragm). Methods that can detect the diaphragm dynamic movement include capacitive detection, optical detection, and the like. In theory, the diaphragm pressure gradient microphone has the same frequency response as shown in FIG. 2. However, since the thin diaphragm has its own dynamic characteristics, the resultant frequency response becomes more complicated and is often highly non-linear. In addition, the useful frequency range becomes very limited. Another drawback of this type sensor, which is the same as in the finite difference microphone, is that as the frequency goes lower, the pressure gradient generates less force on the diaphragm. Consequently the sensor suffers poor signal-to-noise ratio at low frequency.

A new sensing mechanism was proposed in late 90s, which directly detects particle velocity. This sensor is fabricated by micro-electro-mechanical-systems (MEMS) technology and relies on the thermal effect to sense the air acoustic movement. Although this is the first sensor that can measure particle velocity in the air and has a small size, it has prominent shortcomings. This microphone consists of a couple of hot wires that have to be exposed to air and maintained at high temperature during use. This may present a danger in some application environments. In addition, the sensitivity or frequency response of this sensor is inherently very nonlinear (both in amplitude and in phase), which will introduce measurement errors and cause problems with respect to signal processing and sound and vibration control.

All the pressure gradient and velocity microphones mentioned above are unidirectional sensors. In other words, these microphones are only sensitive in one direction and insensitive in other directions. But, in the real world when an acoustic wave is propagating in space, the particle velocity or acoustic gradient associated with the traveling wave is a vector quantity in space, rather than a single direction vector. Therefore, in order to measure three-dimensional (3D) acoustic vector quantities, three of the directional microphones are required and they have to be allocated closely, orthogonally to each other so that the X, Y, Z components (e.g., in a Cartesian coordinate system) of the acoustic vector can be respectively measured. Packaging multiple sensors in one small housing may create interference between sensors. Moreover, the packaging structure may distort the acoustic wave and cause measurement errors.

Embodiments of a directional acoustic sensor or an acoustic velocity microphone are disclosed that suspend a small buoyant solid object in the air to follow the velocity of acoustic particles. The dynamic velocity of the buoyant object can be detected using different detection means, such as an optical detection means, an electromagnetic detection means, and an electrostatic detection means.

An embodiment of the acoustic velocity microphone may be a three-dimensional (3D), directional vector sensor that is capable of directly detecting the velocity of an acoustic particle (referred to as "particle velocity") at a single point as a vector amount, as opposed to sensing acoustic pressure, which is a scalar quantity. The acoustic velocity microphone may have a constant (flat) frequency response both in amplitude and phase, covering the human audible frequency range (e.g., 20 Hz-20 kHz) or beyond. The acoustic vector sensor may adjust the detection direction in any orientation in space and may block sounds from other orientations.

Embodiments of the acoustic velocity microphone may be used, for example, for acoustic and vibration measurement, active acoustic and vibration control, sound source tracking, audio recording, and security monitoring. With wide bandwidths and linear responses, the acoustic velocity microphone may improve the measurement accuracy and enhance sound and vibration control capabilities. Furthermore, an array of the acoustic velocity microphones may be used to obtain an image of a sound propagating field in space. The information extracted from such an image may be helpful for noise source identification and active acoustic and vibration control.

The acoustic medium of air is invisible to human eyes, so is an acoustic wave and an acoustic particle vibrating with the acoustic wave. It is difficult to detect the movement of an invisible acoustic particle. Embodiments of the acoustic velocity microphone may use a buoyant object (e.g., buoyant solid object, solid sphere, or solid object) floating in the air to follow the movement of an acoustic particle, and detect the movement of this visible buoyant object to obtain the particle velocity of the acoustic wave.

Figure 3:
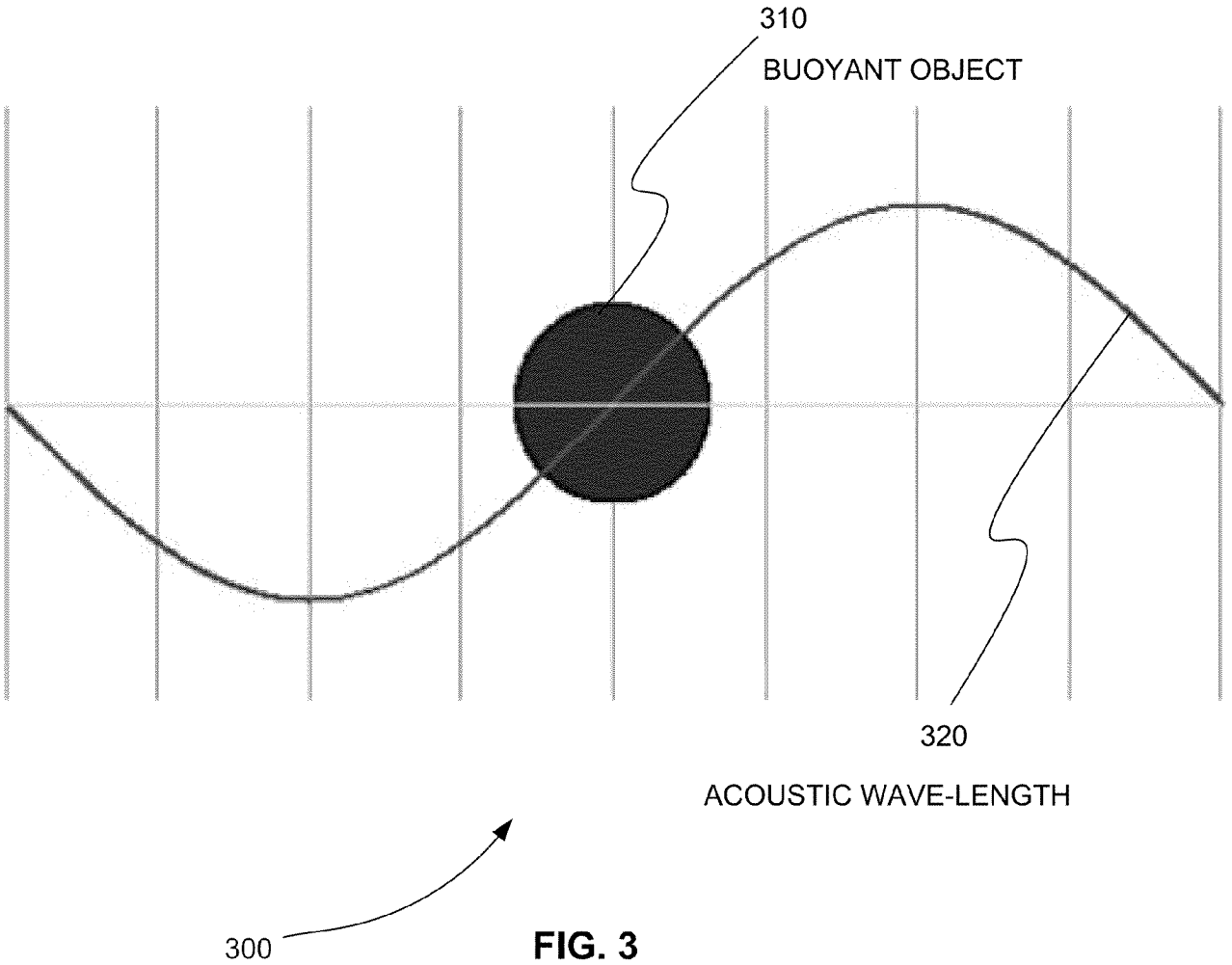
FIG. 3 is an illustration of an exemplary buoyant object of an acoustic velocity microphone shown in relation to an acoustic wavelength 320, in accordance with various embodiments.

FIG. 3 is an illustration 300 of an exemplary buoyant object 310 of an acoustic velocity microphone shown in relation to an acoustic wavelength 320, in accordance with various embodiments. The feature size of the buoyant object 310 may be smaller than the wavelength of an acoustic wave (also referred to as "acoustic wavelength"). The feature size can be, but is not limited to, the maximum length or diameter. The density of the buoyant object 310 may be close (or substantially identical) to the air density (e.g., close to a neutrally buoyant condition). The buoyant object 310 follows the movement of the acoustic particle of the acoustic wave passing through the buoyant object. In other words, the velocity of the buoyant object is the same as or similar to the particle velocity of the acoustic wave.

In the example shown in FIG. 3, the velocity response of the buoyant object 310 may be calculated by, $$\frac{V_x}{U_a} = \frac{3}{(1+2\gamma)} \tag{5}$$

where: $V_x$ is the induced velocity of the buoyant object 310; $U_a$ is the velocity of the acoustic particle (i.e., particle velocity or acoustic velocity); $\gamma$ is the density ratio of the buoyant object 310 to air ($\gamma=\rho_{sphere}/\rho_{air}$).

The velocity of the buoyant object 310 has a direct linear relation with the particle velocity of the acoustic wave. In other words, the velocity of the buoyant object 310 is in-phase with the particle velocity of the acoustic wave. When the velocity of the visible buoyant object 310 is detected using one or more detection means, the particle velocity of the acoustic wave may be derived from it.

The particle velocity of the acoustic wave can be calculated by the detection means, for example. In various embodiments, the particle velocity of the acoustic wave can be calculated by a processor. This processor can be part of the detection means or can be a separate device. The processor can include, but is not limited to, a computer, a microprocessor, an application specific integrated circuit, or any device capable of executing a series of instructions.

As the feature size of the buoyant object 310 gets closer to the acoustic wavelength 320, a more general formula for the velocity response of the buoyant object 310 may be, $$\frac{V_x}{U_a} = \frac{3}{\sqrt{(1+2\gamma)^2 + (1+2\gamma)\cdot(ka)^2 + \gamma^2(ka)^4}} \cdot e^{i\varphi} \tag{6}$$

where: a is the radius of the buoyant object 310; k is the wave number; $\phi$ is the phase, and $$\varphi = -ka + \arctan\left\{\frac{(1+2\gamma)\cdot ka}{(1+2\gamma) - \gamma(ka)^2}\right\} \tag{7}$$

An object that has the same density of air may be difficult to find. An embodiment of the acoustic velocity microphone may use a material that has a density that is greater than the air density.

Figure 4:
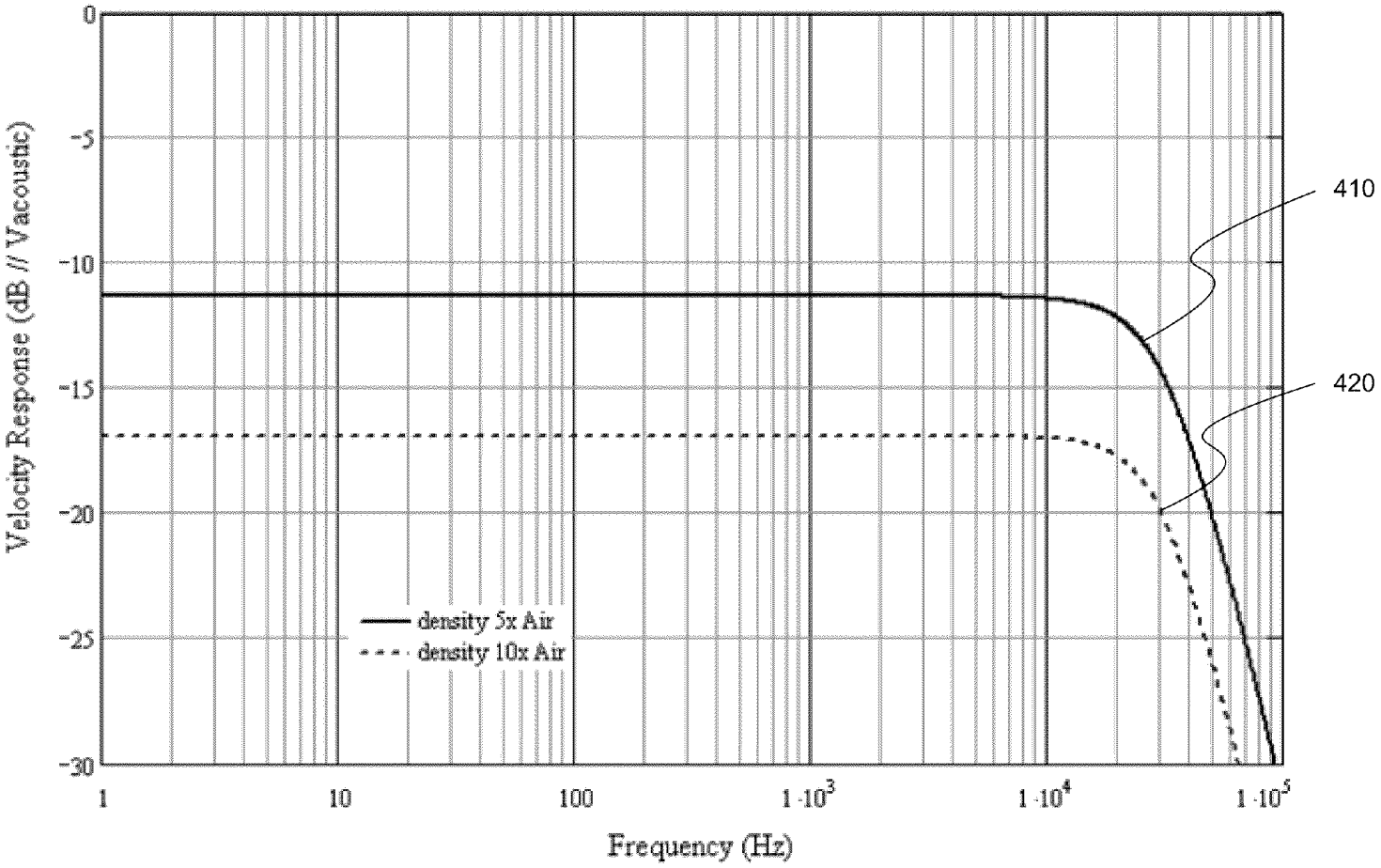
FIG. 4 is an exemplary plot of exemplary velocity responses of two unconstrained buoyant objects with different densities, in accordance with various embodiments.

FIG. 4 is an exemplary plot 400 of exemplary velocity responses 410 and 420 of two unconstrained buoyant objects with different densities, in accordance with various embodiments. The two buoyant objects with velocity responses 410 and 420 each have a feature size of 6 mm, for example. One buoyant object has a density five times greater than the density of air, and the other buoyant object has a density ten times greater than the density of air. The velocity responses 410 and 420 of these two buoyant objects may be obtained according to equations 6 and 7.

As shown in FIG. 4, the velocity responses are constant relative to the particle velocity of the acoustic wave and are independent of the frequency up to a threshold frequency of, for example, about 20 kHz. At a frequency above the threshold frequency, the velocity response of the buoyant object may drop quickly. This is because as the frequency gets higher, its wavelength becomes shorter. Until the wavelength is comparable to the size of the buoyant object, the net force exerted on the buoyant object by the acoustic wave may drop dramatically. Also, FIG. 4 shows that when a buoyant object gets heavier (higher density), its velocity response is lower. As also shown in FIG. 4, the buoyant object with a density ten times greater than the air density has about a 5 dB lower velocity response (420) than the buoyant object with a density greater than five times the air density (410). However, the velocity response's linear relationship to the acoustic wave may be preserved regardless of the density of the buoyant object (before the drop around the threshold frequency).

An embodiment of the acoustic velocity microphone may use the buoyant object as the sensing means to obtain an particle velocity vector at the center of the buoyant object. The three-dimensional dynamic movement of the buoyant object may be measured using one or more detection means, such as an optical detection means, an electromagnetic detection means, and an electrostatic detection means, for example. Although the Figures illustrate a sphere shape of the buoyant object, which is easy to be modeled in mathematics, one skilled in the art will readily appreciate that the buoyant object can have other shapes, such as cube and ellipsoid, and can be a hollow shell object.

In an embodiment of the acoustic velocity microphone, the particle velocity of the acoustic wave may be measured in full three-dimensional (3D) components, namely, X, Y, Z velocity components in a Cartesian coordinate system. Alternatively, the particle velocity of the acoustic wave may be measured in one or two components. If the acoustic velocity microphone measures one component of a vector, the acoustic velocity microphone may be referred to as a uniaxial sensor. If the acoustic velocity microphone measures two components, the acoustic velocity microphone may be referred to as a biaxial sensor. If the acoustic velocity microphone measures three components, the acoustic velocity microphone may be referred to as a triaxial or vector sensor.

The buoyant object may not freely stay in space. In other words, the buoyant object may need to be restrained within a support means. The support means can be a physical support or a non-physical, or non-contact support.

Figure 5:
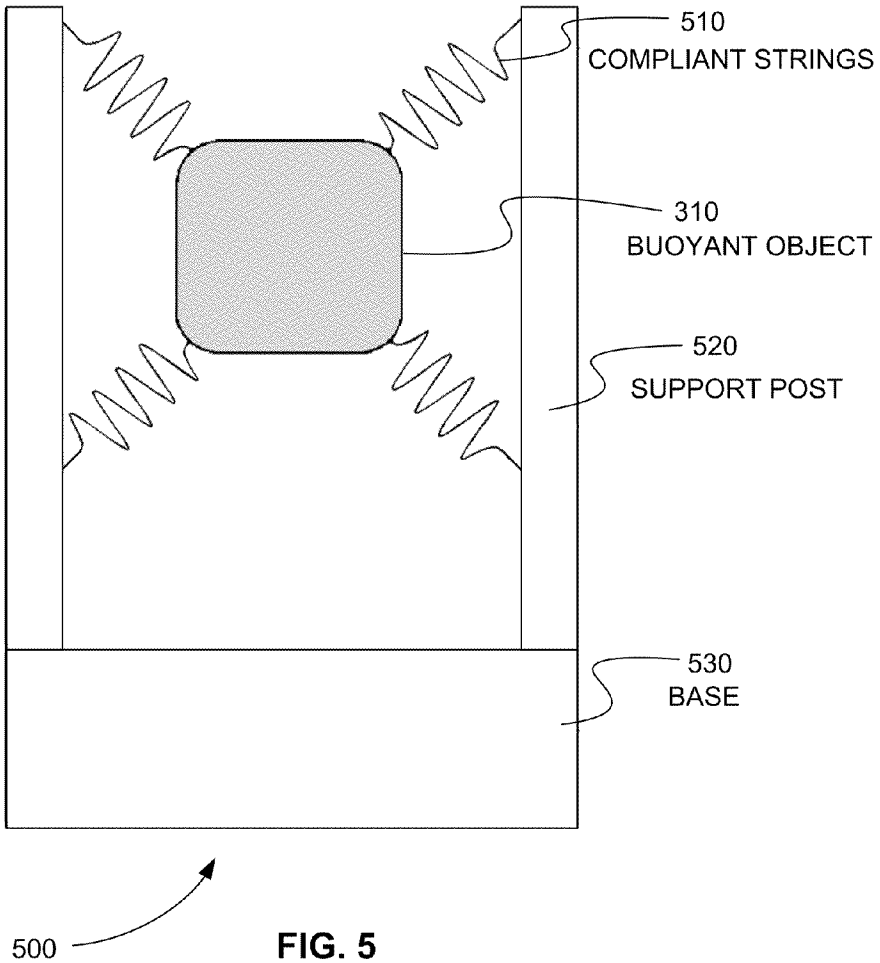
FIG. 5 is an exemplary schematic diagram of an acoustic velocity microphone that uses fine compliant strings or springs to confine the buoyant object in a sensor frame structure that includes a support post and a base, in accordance with various embodiments.

FIG. 5 is an exemplary schematic diagram of an acoustic velocity microphone 500 that uses fine compliant strings or springs 510 to confine the buoyant object 310 in a sensor frame structure that includes a support post 520 and a base 530, in accordance with various embodiments. Fine compliant strings 510 are an example of a physical support. The fine compliant strings 510 may confine the buoyant object 310 so that the buoyant object 310 maintains a fixed position and orientation relative to the sensor frame structure.

Figure 6:
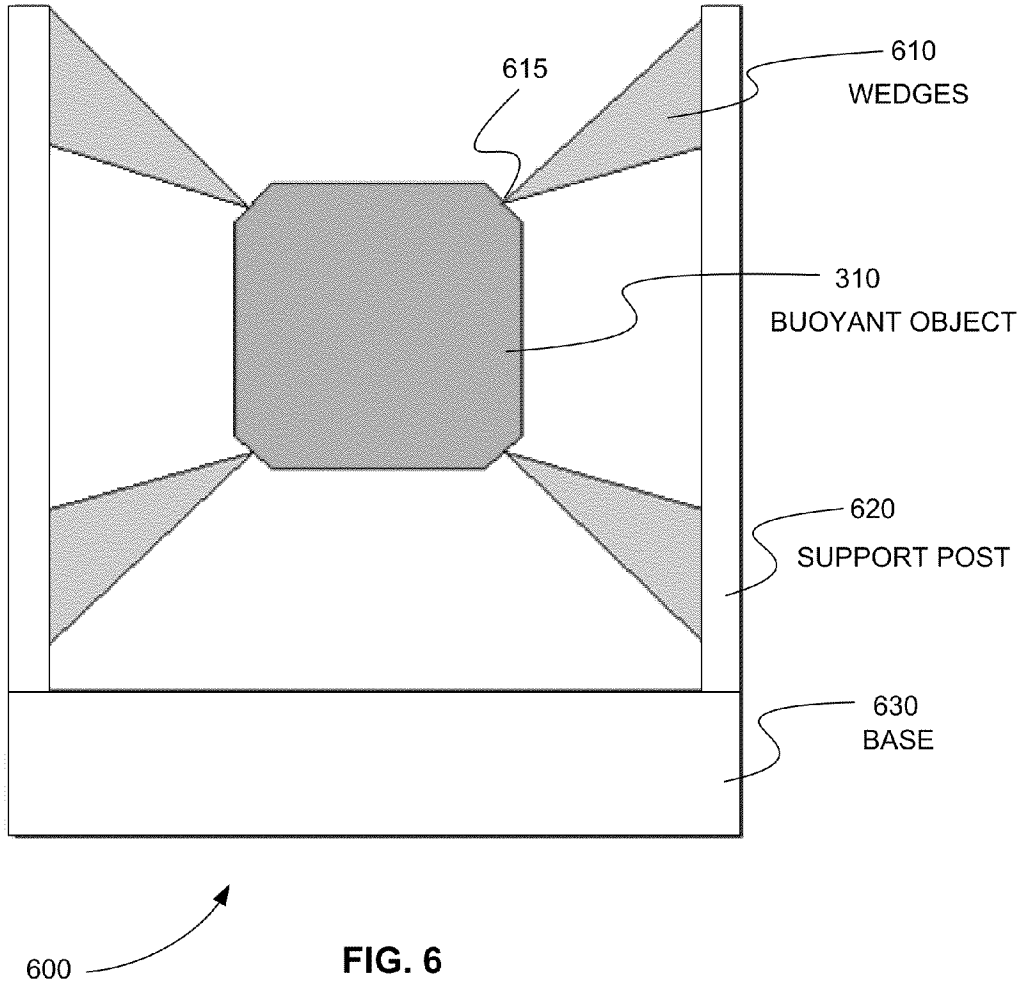
FIG. 6 is an exemplary schematic diagram of an acoustic velocity microphone that uses soft wedges to confine the buoyant object in a sensor frame structure that includes a support post and a base, in accordance with various embodiments.

FIG. 6 is an exemplary schematic diagram of an acoustic velocity microphone 600 that uses soft wedges 610 to confine the buoyant object 310 in a sensor frame structure that includes a support post 620 and a base 630, in accordance with various embodiments. The soft wedges 610 may be made from elastomer or soft sponge, for example. The soft wedges 610 may provide physical support for the buoyant object 310.

The support means (or constraint) of a buoyant object may need to be symmetric in a 3D space so that the buoyant object may have a uniform response in all directions. The support coupled with the buoyant object may form a spring-mass dynamic system, which may affect the flat frequency response in a low frequency range. The mechanical resonance of the support and the buoyant object may be referred to as a mounting resonance, which may be superimposed onto the original buoyant object frequency response.

Figure 7:
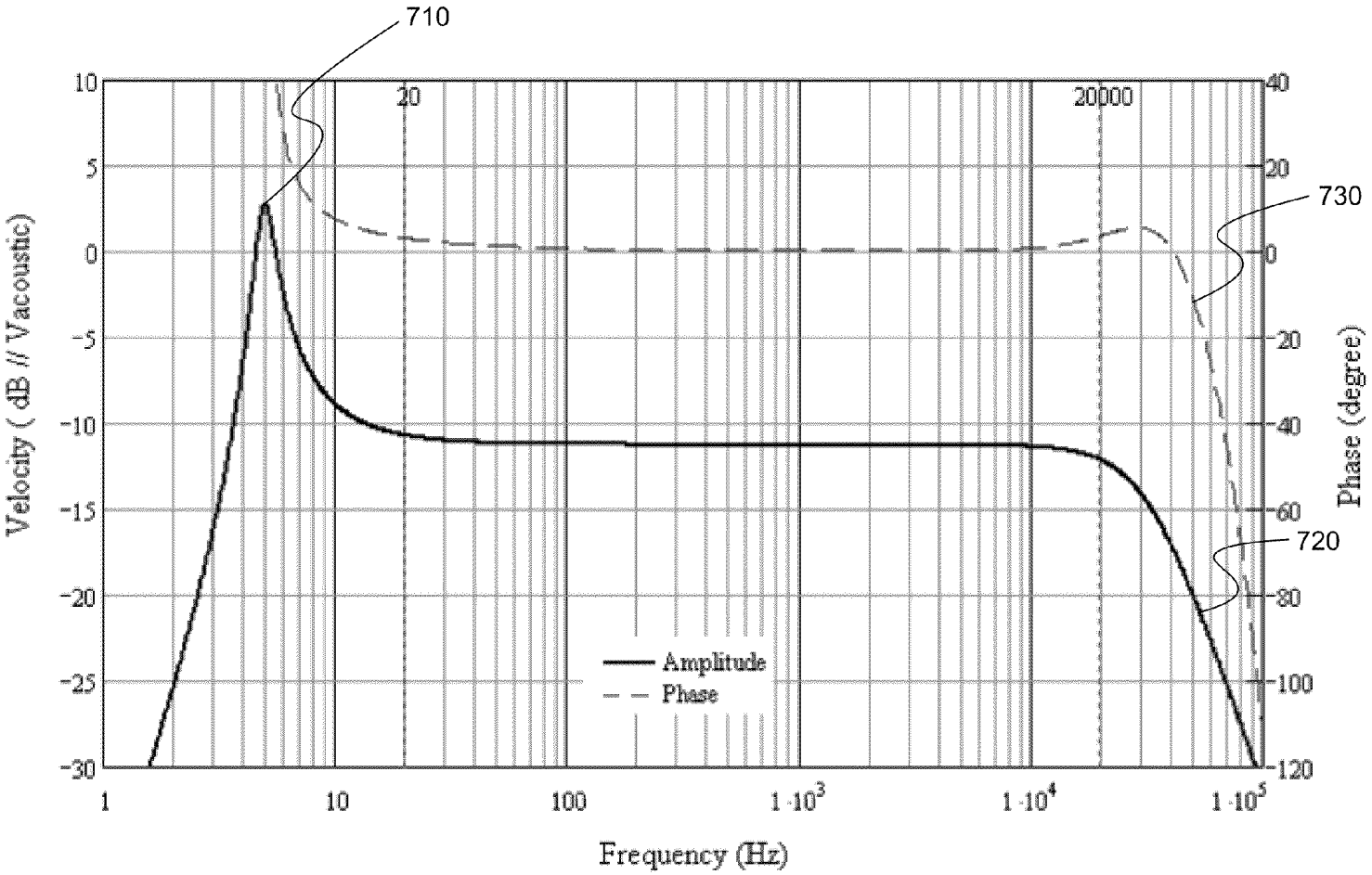
FIG. 7 is an exemplary plot a frequency response (amplitude and phase) of a constrained buoyant object, including a mounting resonance (i.e., peak) at a low frequency, in accordance with various embodiments.

FIG. 7 is an exemplary plot 700 a frequency response (amplitude 720 and phase 730) of a constrained buoyant object, including a mounting resonance 710 (i.e., peak) at a low frequency, in accordance with various embodiments. The peak 710 of the frequency response may come from the mechanical resonance of the support means and the buoyant object. FIG. 7 shows that the lower the mounting resonance (corresponding to more compliant support), the wider the frequency range may be in the low end. In the example shown in FIG. 7, the mounting resonance 710 is about 5 Hz and the acoustic velocity microphone has a fairly constant response from 20 Hz to 20,000 Hz, which covers the entire human audible frequency range.

The buoyant object may have its own dynamic characteristics, which may interact with the acoustic wave and create a peak response like resonance. Such an interaction may happen at very high frequency and outside of the human audible frequency range.

Figure 8:
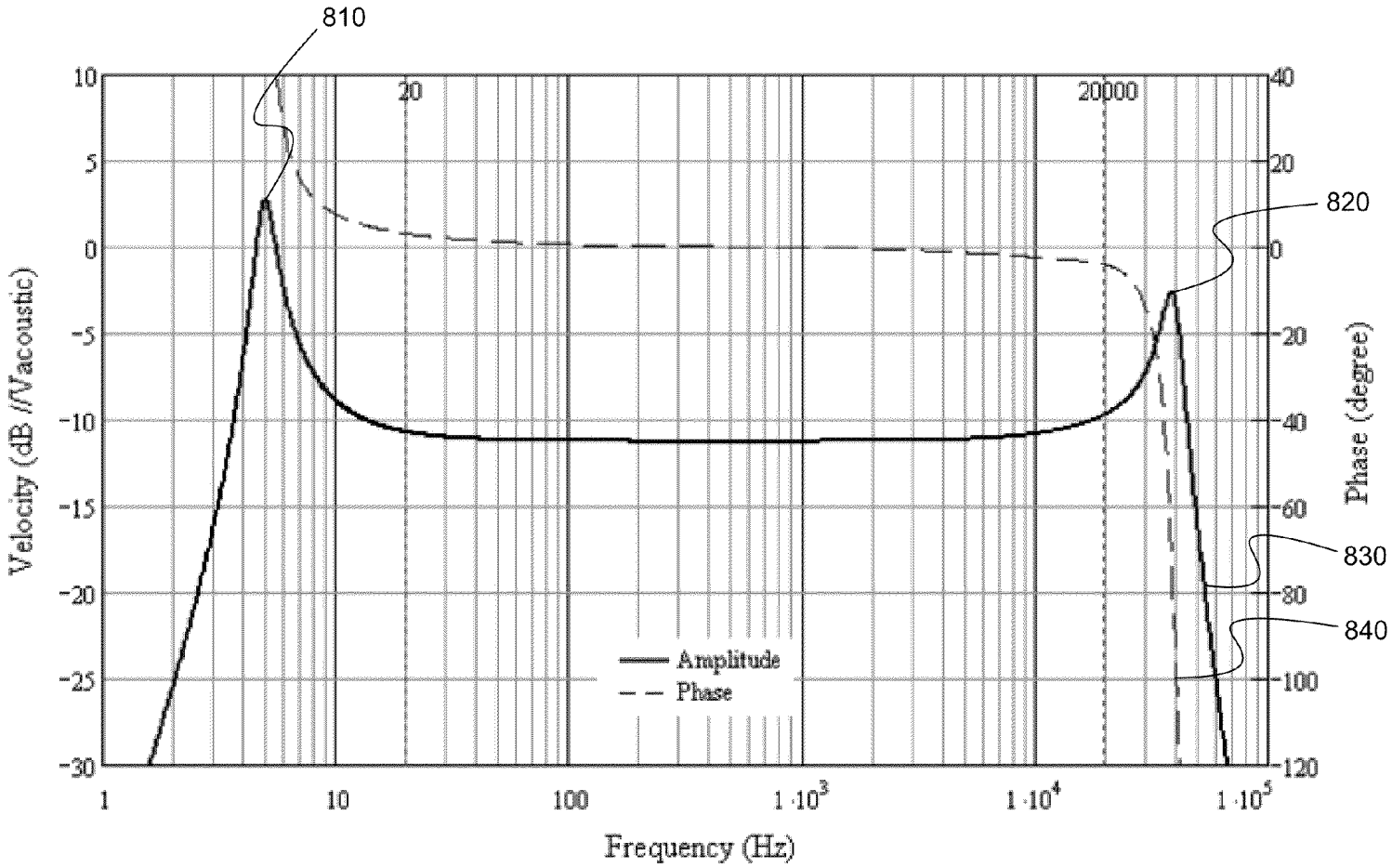
FIG. 8 is an exemplary plot of a velocity frequency response (amplitude and phase) of a constrained buoyant object with a mounting resonance at a low frequency and a dynamic resonance (i.e., dynamic peak) at a high frequency, in accordance with various embodiments.

FIG. 8 is an exemplary plot 800 of a velocity frequency response (amplitude 830 and phase 840) of a constrained buoyant object with a mounting resonance 810 at a low frequency and a dynamic resonance 820 (i.e., dynamic peak) at a high frequency, in accordance with various embodiments. The high frequency peak 820 may effectively compensate for the fast output drop from the acoustic wavelength effect (as shown in FIG. 7), thus making the frequency response slightly higher around 20 kHz. As a result, an acoustic velocity microphone may be designed with an extended upper frequency over, for example, 30 kHz or 40 kHz (e.g., in ultrasonic range).

As noted above, the particle velocity of the acoustic wave may be obtained by detecting and measuring the movement of the buoyant object using, for example, an optical detection means, an electromagnetic detection means, and an electrostatic detection means, for example. Regarding the optical detection means, the velocity of an oscillating buoyant object induced by an acoustic wave may be detected by a laser vibrometer that uses the Doppler effect. When impinging a laser beam onto the moving buoyant object, the scattered light reflecting back from the oscillating buoyant object may have its frequency shifted due to the Doppler effect. The amount of frequency shift may depend on the velocity of the buoyant object, $$\Delta f = 2V_o/\lambda \tag{8}$$

where: $\Delta f$ is the frequency shift; $\lambda$ is the wavelength of the laser light; $V_o$ is the velocity of the buoyant object along the impinging light beam. After measuring the frequency shift from the reflected laser, the velocity of the buoyant object may be obtained.

A laser Doppler vibrometer (LDV) typically measures objects far away (in meters). A LDV typically has a powerful laser source and sophisticated optical lenses to focus and collect the light, so the resultant LDV is bulky and expensive.

In an embodiment of the acoustic velocity microphone, the detection distance (from the impinging laser beam and the collecting head to the vibrating buoyant object) may be small. As a result, a small-sized, low-powered laser diode may be sufficient. A single mode glass fiber may be employed instead of a complicated optical lens system to guide the laser to the buoyant object and collect the scattered light to an optic-electric circuit. The result is a compact laser-fiber vibrometer with much lower cost. More importantly, the compact laser-fiber vibrometer may be easily integrated with the buoyant object detection structure to form a true acoustic velocity microphone.

Figure 9:
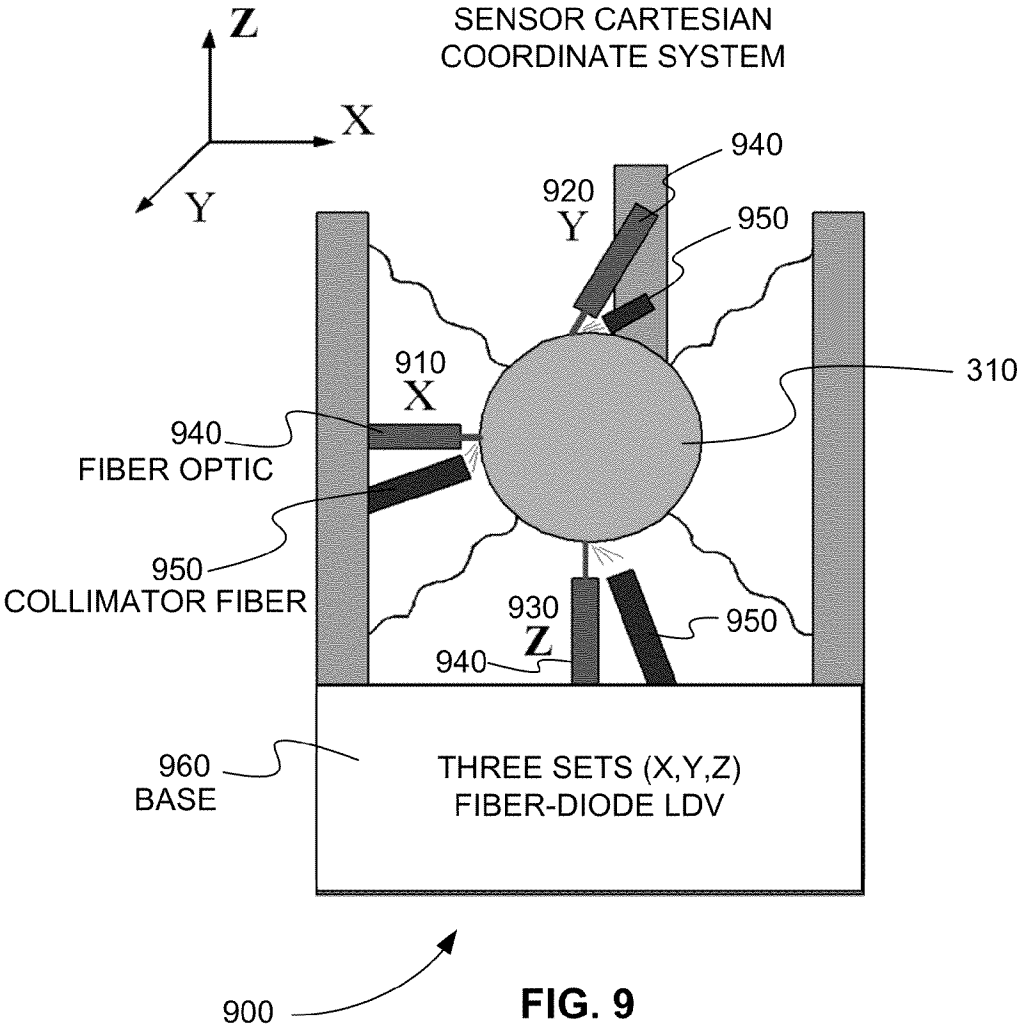
FIG. 9 is an exemplary schematic diagram of an acoustic velocity microphone with a detection means that includes three orthogonally placed laser-fiber vibrometers, in accordance with various embodiments.

FIG. 9 is an exemplary schematic diagram of an acoustic velocity microphone 900 with a detection means that includes three orthogonally placed laser-fiber vibrometers, in accordance with various embodiments. Because the measurement is a vector quantity, three sets of the laser-fiber vibrometers may be needed in one acoustic velocity microphone so that the X, Y, Z components (910, 920, 930, respectively) of the particle velocity of the acoustic wave may be respectively measured. Nevertheless, one or two of such vibrometers may be used to measure the partial quantity of the particle velocity vector. If only one laser-fiber vibrometer is used, a single axis acoustic velocity microphone may be formed. If two laser-fiber vibrometers are used, a biaxial velocity microphone may be formed. Referring to FIG. 9, an optical fiber or fiber optic 940 may guide the laser light to the buoyant object 310. The direction of the impinging laser along a guiding optical fiber 940 may define the measurement direction, e.g., the directions of X, Y, Z axes. Another optical fiber or a collimator fiber 950 may be placed closely to the impinging laser spot on the buoyant object 310 with a slant angle to collect the scattered laser light. A base 960 provides sensor structural support and contains fiber-diode LDVs.

Figure 10:
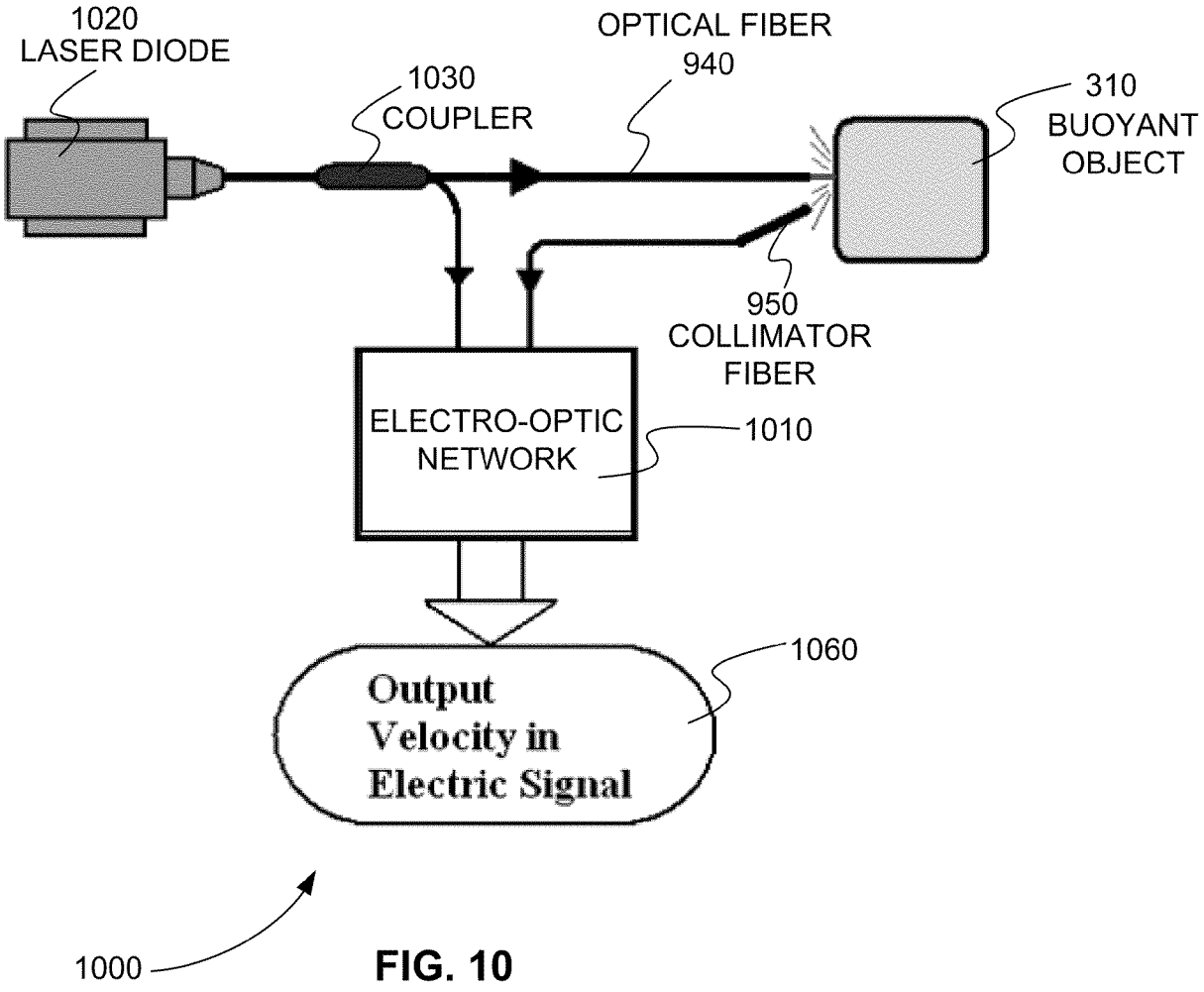
FIG. 10 is an exemplary schematic diagram of an optical detection means including an electro-optic network of the vibrometer that is packaged in the base of the sensor housing, in accordance with various embodiments.

FIG. 10 is an exemplary schematic diagram of an optical detection means including an electro-optic network 1010 of the vibrometer that is packaged in the base 960 (shown in FIG. 9) of the sensor housing, in accordance with various embodiments. The laser light from a laser diode 1020 is guided by a coupler 1030 and the optical fiber 940 to the buoyant object 310. Another optical fiber or the collimator fiber 950 may be placed closely to the impinging laser spot on the buoyant object 310 with a slant angle to collect the scattered laser. This collected laser may then be sent back to the electric-optic network 1010, and the Doppler frequency shift in the light is resolved. Due to the simple linear relation between the frequency shift and the velocity of the buoyant object 310 given in equation 8, the velocity of the buoyant object 310 may be obtained. The velocity of the buoyant object 310 may be output in an electric signal (block 1060).

Referring back to FIG. 9, three fiber optics 940 from three vibrometers may be mounted orthogonally to each other around the buoyant object 310, so that the velocity components along X, Y, Z components in a Cartesian coordinate system may be directly measured. If the three impinging fiber optics 940 from the three vibrometers are mounted in angles other than 90 degree, the three measured velocities may need to be translated by trigonometry to become the velocity components in a Cartesian coordinate system.

Figure 11:
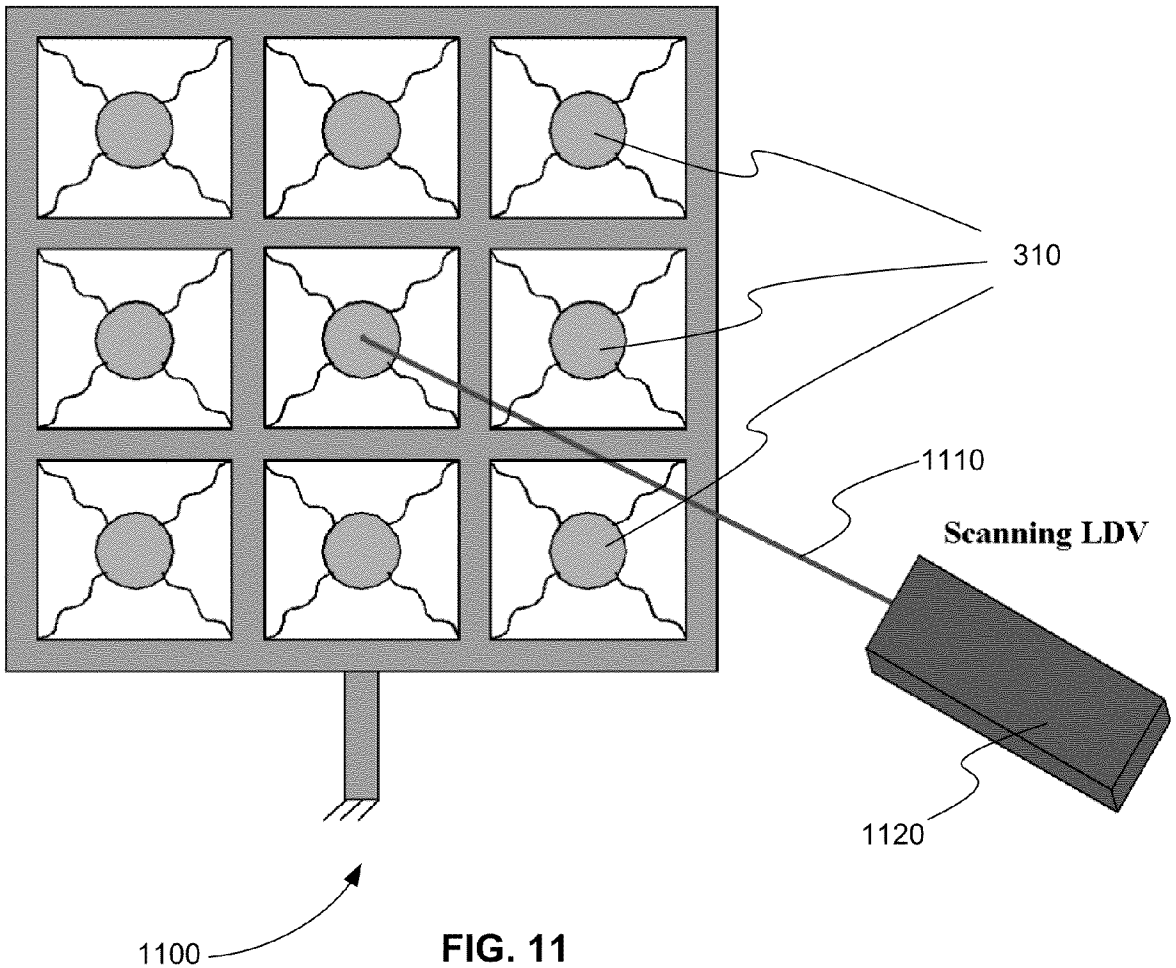
FIG. 11 is an exemplary schematic diagram of an acoustic imaging system that includes a two-dimensional (2D) array directional acoustic sensors of buoyant objects and a scanning laser Doppler vibrometer (LDV), in accordance with various embodiments.

FIG. 11 is an exemplary schematic diagram of an acoustic imaging system 1100 that includes a two-dimensional (2D) array directional acoustic sensors of buoyant objects and a scanning laser Doppler vibrometer (LDV) 1120, in accordance with various embodiments. A buoyant object detection structure may be arranged in a multi-dimensional (2D or 3D) array formation so that an acoustic propagating field in a 2D plane or a 3D space may be measured. The sound velocity distribution on a plane, which is often called acoustic image, may be useful for applications, such as noise source identification, sound and vibration control, and room acoustic characterization. In this situation, the detection can be performed by a commercially available scanning LDV 1120, which can sweep a laser beam 1110 onto each buoyant object 310 and measure its velocity respectively. After assembling all the measured acoustic velocities at the locations of the buoyant objects 310, an image of acoustic propagating field may be obtained. A single detection means is used for multiple sensors in FIG. 11 for illustration purposes. One skilled in the art will appreciate that multiple detection means may be used. For example, a separate detection means can be used for each sensor.

Figure 12:
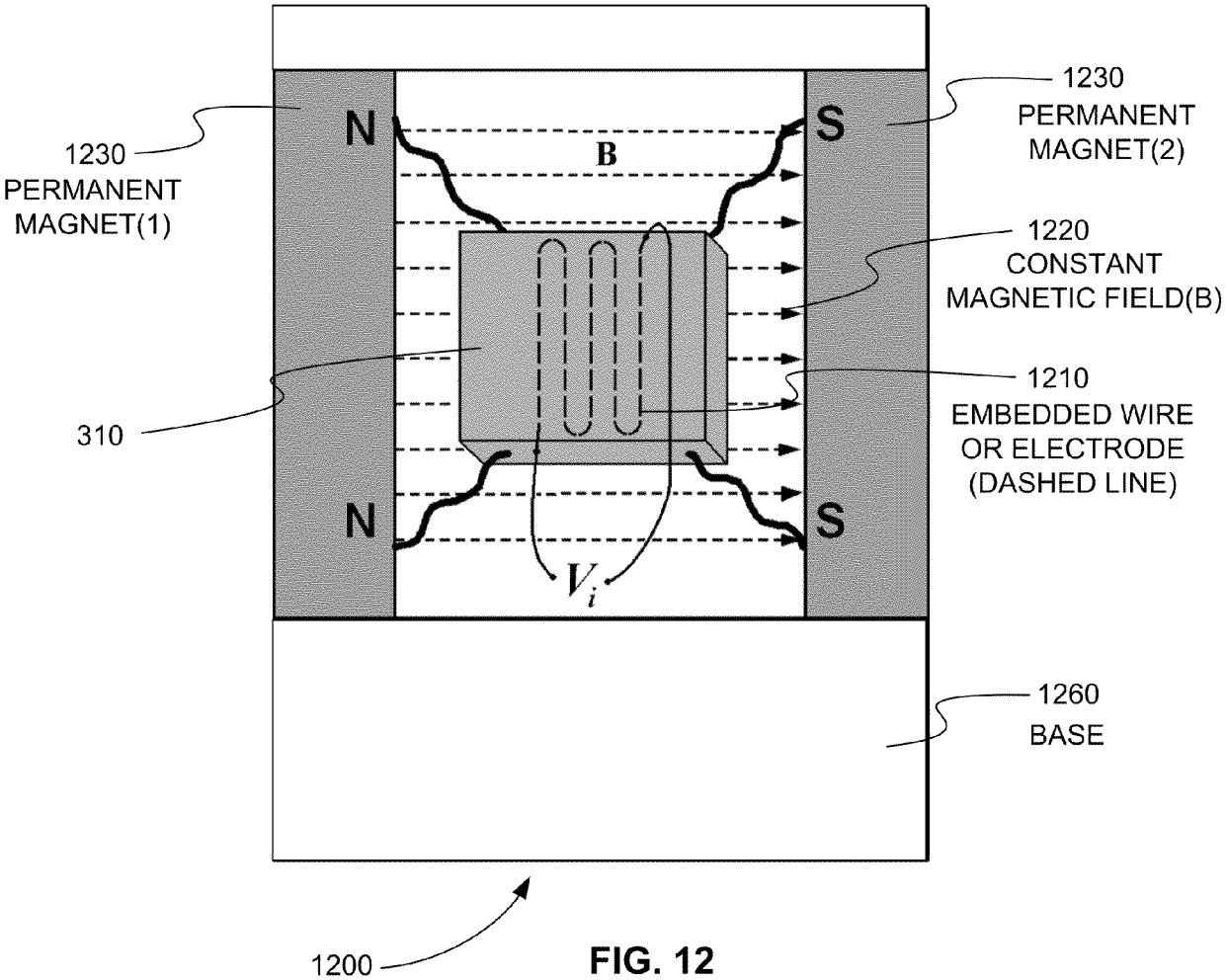
FIG. 12 is an exemplary schematic diagram an acoustic velocity microphone that includes an electromagnetic detection means, in accordance with various embodiments.

FIG. 12 is an exemplary schematic diagram an acoustic velocity microphone 1200 that includes an electromagnetic detection means, in accordance with various embodiments. Strip electrodes or fine metal wires 1210 may be embedded in the buoyant object 310, or may be placed on the outside surface of the buoyant object 310. Permanent magnets 1230 may be positioned closely to the buoyant object 310 on base 1260, so that a constant magnetic field 1220 is exerted around the buoyant object 310. When the buoyant object 310 follows the acoustic wave and starts vibrating, the strip electrodes or the fine metal wires 1210 may cut through the magnetic field 1220 and result in electric potential (a.k.a, motional emf) at the ends of the strip electrodes or fine metal wires 1210. When the moving direction is vertical to the magnetic field 1220, the induced electric potential V, may be calculated by, $$V_i = -BLV_o \tag{9}$$

where: B is magnetic field, L is the total effective conductor length, Vo is the moving velocity of the buoyant object 310.

Since the magnetic field B and conductor length L are constant, the motion induced electric potential $V_i$ has a linear relation with the moving velocity $V_o$ of the buoyant object 310. By measuring the induced electric potential, the particle velocity of the acoustic wave may be obtained. The velocity microphone based on this detection means has simple structure and can be easily made. While it may be difficult to create a triaxial sensor (true vector measurement) using this detection means, an uniaxial acoustic velocity microphone may be created using this detection means.

Figure 13:
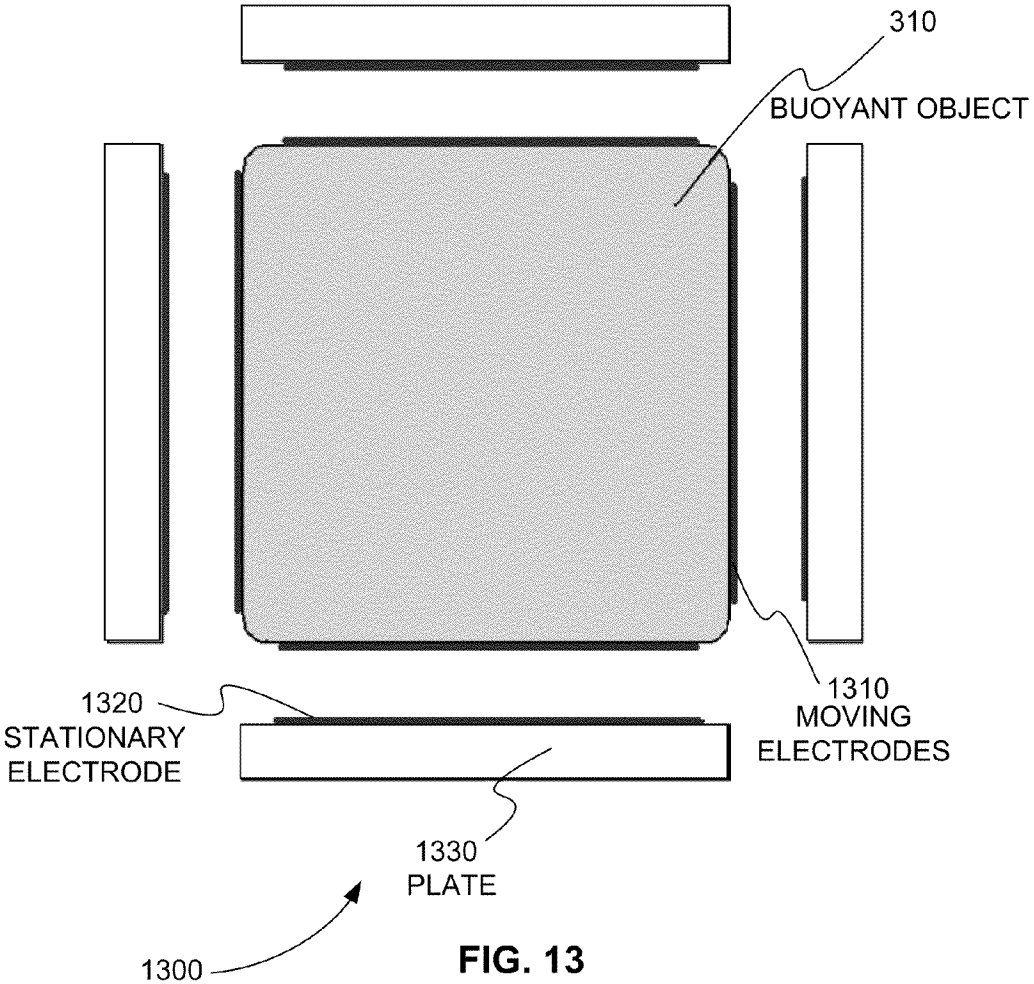
FIG. 13 an exemplary schematic diagram an acoustic velocity microphone that includes an electrostatic detection means, in accordance with various embodiments.

FIG. 13 an exemplary schematic diagram an acoustic velocity microphone 1300 that includes an electrostatic detection means, in accordance with various embodiments. One or more moving electrodes 1310 may be plated on the buoyant object 310 on three orthogonal surfaces. Pairing with each moving electrode 1310 is a stationary electrode 1320 that is affixed to a plate 1330 attached to a host structure of the acoustic velocity microphone. Each pair of moving and stationary electrodes may form a parallel capacitor. If the buoyant object 310 is a dielectric material, when a high static electric potential is applied to the parallel capacitors, the static electrostatic force may support the buoyant object 310. The parallel capacitors are, therefore, an example of non-physical support. In this embodiment, the fine springs and soft wedges (shown in FIGS. 5 and 6) are not needed. When an acoustic wave induces the buoyant object 310 to move with the acoustic particles, the gaps between the parallel capacitors change accordingly. By detecting the change in the distance between the parallel capacitors, the particle velocity of the acoustic wave may be extracted. Fundamentally, the electrostatic detection means measures displacement rather than velocity. So the frequency response of the corresponding acoustic velocity microphone may have a −20 dB/decade slope in terms of acoustic pressure or velocity.

Regarding the performance of the acoustic velocity microphone, the optical detection means may be superior over the other two detection means described above. However, the electromagnetic and electrostatic detection means may be easier to implement and may be associated with a lower cost than the optical detection means.

Figure 14:
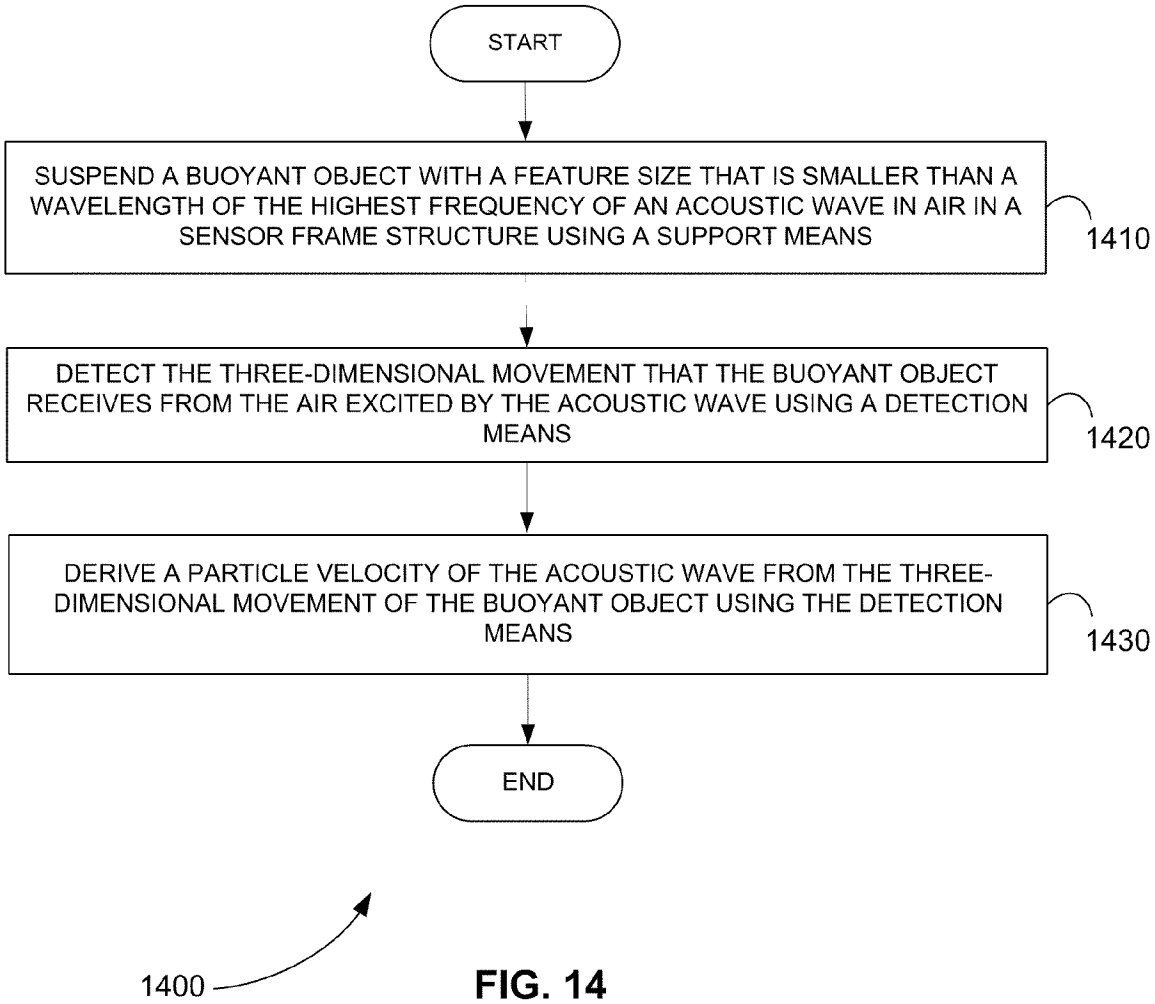
FIG. 14 is a flowchart showing a method for determining a particle velocity of an acoustic wave, in accordance with various embodiments.

FIG. 14 is a flowchart showing a method 1400 for determining a particle velocity of an acoustic wave, in accordance with various embodiments.

In step 1410 of method 1400, a buoyant object with a feature size that is smaller than a wavelength of the highest frequency of an acoustic wave in air is suspended in a sensor frame structure using a support means.

In step 1420, the three-dimensional movement that the buoyant object receives from the air excited by the acoustic wave is detected using a detection means.

In step 1430, a particle velocity of the acoustic wave object is derived from the three-dimensional movement of the buoyant using the detection means.

Figure 15:
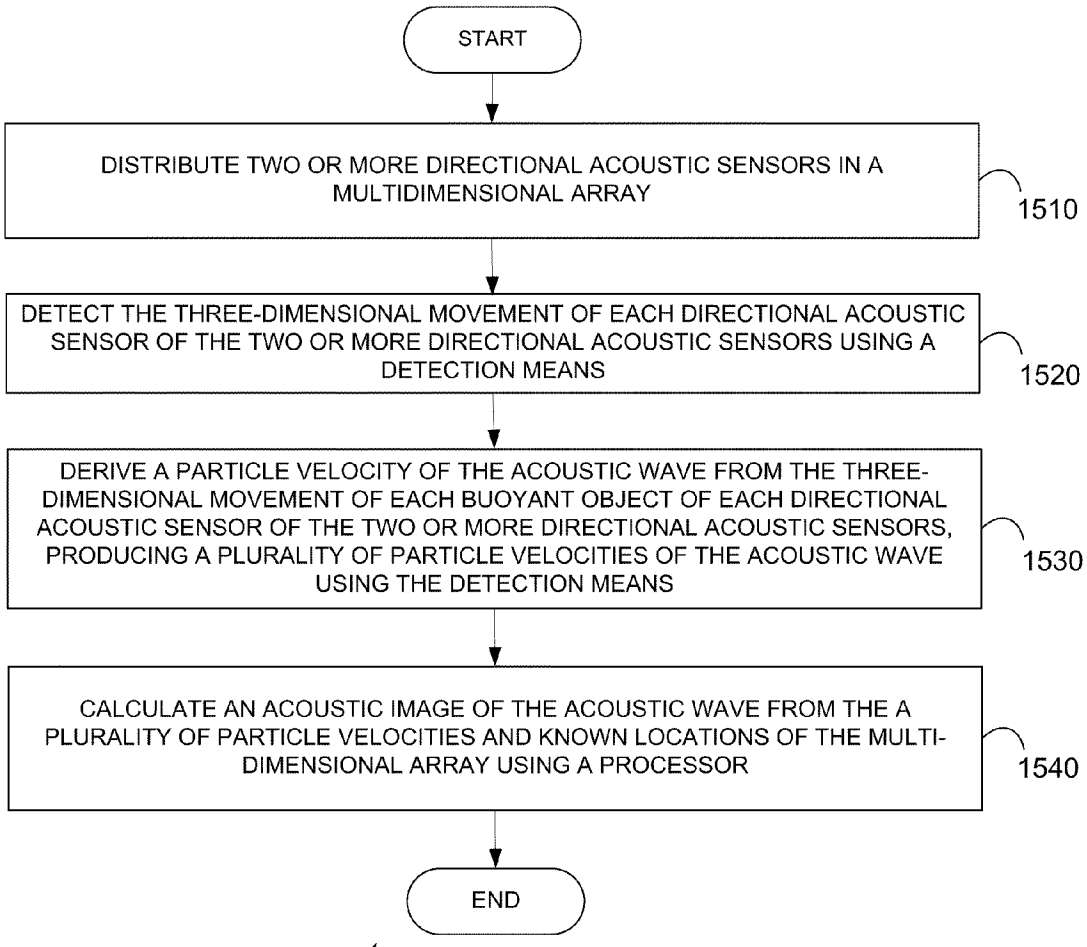
FIG. 15 is a flowchart showing a method for determining an acoustic image of an acoustic wave, in accordance with various embodiments.

FIG. 15 is a flowchart showing a method 1500 for determining an acoustic image of an acoustic wave, in accordance with various embodiments.

In step 1510 of method 1500, two or more directional acoustic sensors are distributed in a multi-dimensional array. Each directional acoustic sensor of the two or more directional acoustic sensors includes a sensor frame structure, a support means, and a buoyant object. The buoyant object is suspended in the sensor frame structure using the support means. The buoyant object has a feature size smaller than a wavelength of the highest frequency of an acoustic wave in air. The buoyant object receives the three-dimensional movement of the air excited by the acoustic wave.

In step 1520, the three-dimensional movement of each directional acoustic sensor of the two or more directional acoustic sensors is detected using a detection means.

In step 1530, a particle velocity of the acoustic wave is derived from the three-dimensional movement of each buoyant object of each directional acoustic sensor of the two or more directional acoustic sensors, producing a plurality of particle velocities of the acoustic wave using the detection means.

In step 1540, an acoustic image of the acoustic wave is calculated from the plurality of particle velocities and known locations of the multi-dimensional array using a processor. As described above, the processor can be part of the detection means or can be a separate device. The processor can include, but is not limited to, a computer, a microprocessor, an application specific integrated circuit, or any device capable of executing a series of instructions.

Although this invention has been described in connection with specific descriptions and embodiments thereof, it will be appreciated that various modifications other than those discussed above may be resorted to without departing from the spirit or scope of the invention. For example, the buoyant object can be made in the form of shell instead of a solid object, the buoyant object can be supported in its center, the optical detection can use laser beam and lens instead of fiber. All these are without departing from the spirit or scope of the invention as defined in the following claims Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A directional acoustic sensor, comprising:

a sensor frame structure;

a support means; and a buoyant object suspended in the sensor frame structure using the support means that has a feature size smaller than a wavelength of the highest frequency of an acoustic wave in air and that receives three-dimensional movement of the air excited by the acoustic wave that is used to derive a particle velocity of the acoustic wave.

2. The directional acoustic sensor of claim 1, further comprising a detection means that detects the three-dimensional movement, calculates a velocity of the buoyant object from the three-dimensional movement, and derives the particle velocity of the acoustic wave from the velocity of the buoyant object.

3. The directional acoustic sensor of claim 1, wherein the buoyant object is a sphere.

4. The directional acoustic sensor of claim 1, wherein the buoyant object is selected from a group consisting of a cube and an ellipsoid.

5. The directional acoustic sensor of claim 2, wherein a linear relation exists between the velocity of the buoyant object and the wavelength of the acoustic wave.

6. The directional acoustic sensor of claim 1, wherein the buoyant object is a hollow shell object.

7. The directional acoustic sensor of claim 2, wherein the particle velocity of the buoyant object is measured in three components in a Cartesian coordinate system and the directional acoustic sensor is a vector sensor.

8. The directional acoustic sensor of claim 2, wherein the particle velocity of the buoyant object is measured in one component in a Cartesian coordinate system and the directional acoustic sensor is a uniaxial sensor.

9. The directional acoustic sensor of claim 2, wherein the particle velocity of the buoyant object is measured in two components in a Cartesian coordinate system and the directional acoustic sensor is a biaxial sensor.

10. The directional acoustic sensor of claim 1, wherein the support means comprises a physical support.

11. The directional acoustic sensor of claim 10, wherein the physical support comprises one or more compliant strings that are symmetric in a three-dimensional space.

12. The directional acoustic sensor of claim 10, wherein the physical support means comprises one or more soft wedges that are symmetric in a three-dimensional space.

13. The directional acoustic sensor of claim 1, wherein the support means comprises a non-physical support.

14. The directional acoustic sensor of claim 13, wherein the non-physical support comprises an electric field.

15. The directional acoustic sensor of claim 2, wherein the detection means is an optical detection means.

16. The directional acoustic sensor of claim 2, wherein the detection means is an electromagnetic detection means.

17. The directional acoustic sensor of claim 2, wherein the detection means is an electrostatic detection means.

18. A method for determining a particle velocity of an acoustic wave, the method comprising:

suspending a buoyant object with a feature size that is smaller than a wavelength of the highest frequency of an acoustic wave in air in a sensor frame structure using a support means, detecting three-dimensional movement that the buoyant object receives from the air excited by the acoustic wave using a detection means; and deriving a particle velocity of the acoustic wave from the three-dimensional movement of the buoyant object using the detection means.

19. A method for determining an acoustic image of an acoustic wave, the method comprising:

distributing two or more directional acoustic sensors in a multi-dimensional array, wherein each directional acoustic sensor of the two or more directional acoustic sensors includes a sensor frame structure, a support means, and a buoyant object suspended in the sensor frame structure using a support means that has a feature size smaller than a wavelength of the highest frequency of an acoustic wave in air and that receives three-dimensional movement of the air excited by the acoustic wave;

detecting three-dimensional movement of each directional acoustic sensor of the two or more directional acoustic sensors using a detection means;

deriving a particle velocity of the acoustic wave from the three-dimensional movement of each buoyant object of each directional acoustic sensor of the two or more directional acoustic sensors producing a plurality of particle velocities of the acoustic wave using the detection means; and calculating an acoustic image of the acoustic wave from the a plurality of particle velocities and known locations of the multi-dimensional array using a processor.

20. The method of claim 19, wherein the detection means comprises a scanning laser Doppler vibrometer (LDV).

* * * * *